US005228599A

United States Patent [19]

Keller

[11] Patent Number: 5,228,599

[45] Date of Patent: Jul. 20, 1993

[54] MULTIPLE DISPENSING CARTRIDGE FOR MULTIPLE-COMPONENT SUBSTANCES

[76] Inventor: Wilhelm A. Keller, Obstgartenweg 9, CH - 6402 Merlischachen, Switzerland

[21] Appl. No.: 731,458

[22] Filed: Jul. 17, 1991

[30] Foreign Application Priority Data

Jul. 20, 1990 [CH] Switzerland ..... 02426/90

[51] Int. Cl.[5] ..... B67D 5/52

[52] U.S. Cl. ..... 222/137; 222/327; 222/145; 222/547; 222/570

[58] Field of Search ..... 222/137, 327, 570, 567, 222/569, 145, 545, 136, 135, 547, 564; 239/590.3, 591

[56] References Cited

U.S. PATENT DOCUMENTS 4,605,225 8/1986 Zimmermann ..... 239/591 X 4,974,756 12/1990 Pearson et al. ..... 222/546 X 5,080,262 1/1992 Herold ..... 222/135

*Primary Examiner*—Gregory L. Huson

*Attorney, Agent, or Firm*—Ostrolenk, Faber, Gerb & Soffen

[57] ABSTRACT

A dispensing cartridge having two storage cylinders with different cross-sectional areas and each having a respective dispensing opening. A connecting piece provided in front of the storage cylinders has a common outlet for the substances contained in the storage cylinders and dispensing channels which are connected to the respective dispensing openings. In a preferred embodiment, the dispensing channel connected with the dispensing opening of the storage cylinder with a smaller cross-section is adapted with an insert so that the ratio of the cross-sections of the dispensing channels corresponds to the ratio of the cross-sections of the associated storage cylinders.

11 Claims, 2 Drawing Sheets

MULTIPLE DISPENSING CARTRIDGE FOR MULTIPLE-COMPONENT SUBSTANCES

The present invention refers to a double or multiple dispensing cartridge for two- or multiple-component substances, comprising storage cylinders having different volumes and a respective dispensing opening each, as well as a connecting piece which is arranged in front of said storage cylinders, said connecting piece having a common outlet for said components in order to connect a mixer tube, and dispensing channels which are joined to said dispensing openings. A double dispensing cartridge featuring these characteristics is described in European Patent Application No. 294,672 of the same applicant.

BACKGROUND OF THE INVENTION

In this cartridge and in other cartridges which are commercially available, the storage cylinders are of equal length. A precise proportioning of the components is obtained by a precise advance of the thrust rods and hence of the pistons, and no consideration is given to the cross-sectional area of the dispensing openings of the storage cylinders or of the dispensing channels of the cartridges. Therefore, regardless of the cross-sectional area of the storage cylinders, the dispensing openings generally have approximately the same dimensions for technical reasons associated to injection-molding. At the beginning of the dispensing operation, or after removing the closure, this leads to a greater quantity being delivered from the larger cartridge to the mixer tube, whereby a certain initial volume is rendered useless and must be discarded. In addition to the loss of material, this results in an unnecessary pollution through a substance which is generally unhardenable, and to an uncertainty as to the correct mixing ratio.

SUMMARY OF THE INVENTION

On this background, it is the object of the present invention to provide a double dispensing cartridge which allows a correct mixing ratio from the very beginning and thus guarantees utilisation of the entire contents of the dispensing cartridges. This object is attained by means of a dispensing cartridge wherein the ratio of the volumes of said dispensing channels corresponds to the ratio of the volumes of the associated storage cylinders.

In a preferred embodiment of the invention, the adaptation of the volume of the dispensing channel in the storage cylinder having a smaller volume is obtained by an insert in the corresponding dispensing channel.

Furthermore, the invention provides a useful closure means which allows to close both (or all) openings in common.

BRIEF DESCRIPTION OF THE DRAWINGS

The invention is explained in more detail hereinafter with reference to a drawing of an embodiment.

DETAILED DESCRIPTION OF THE INVENTION

Figures 5, 6:
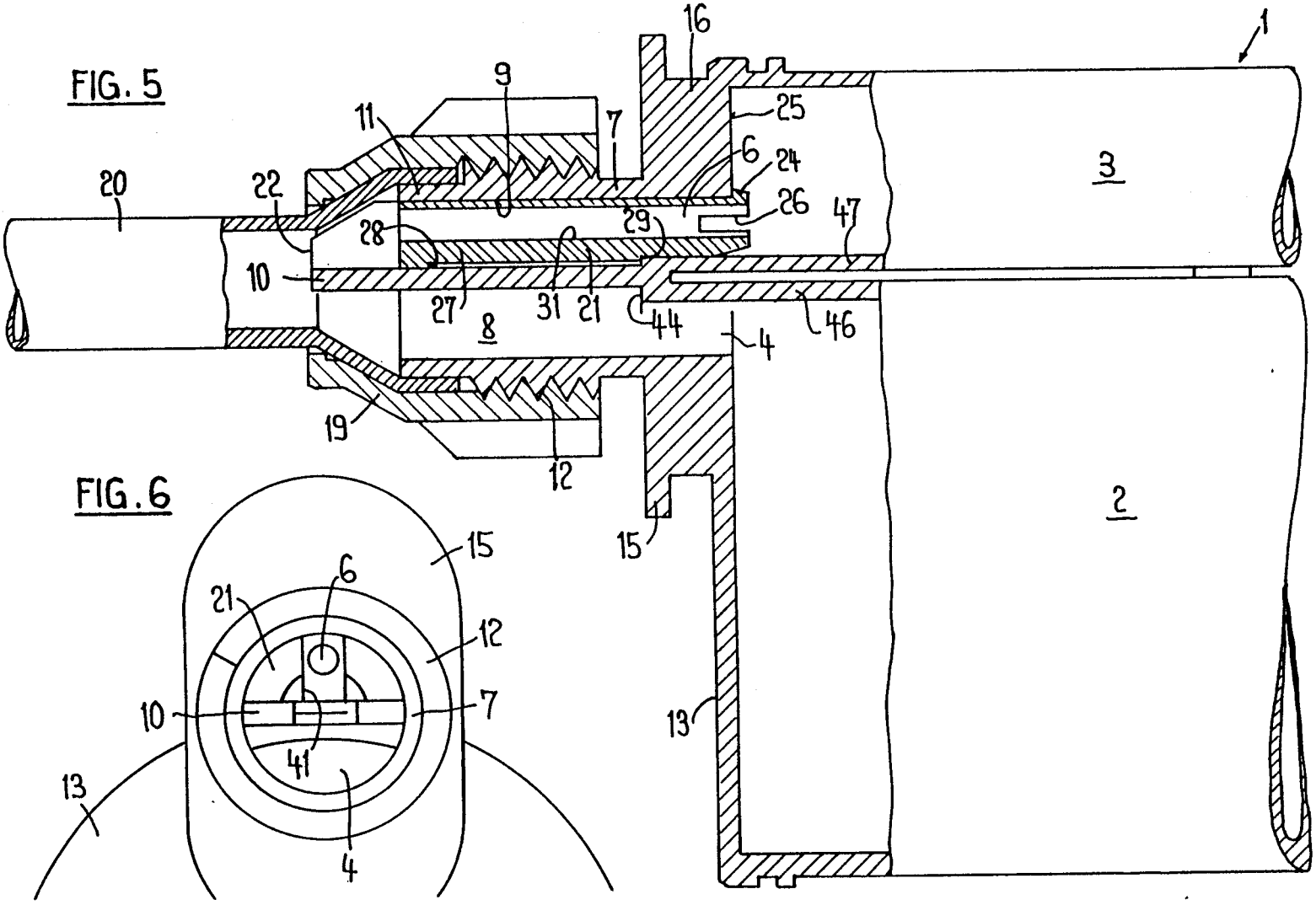
FIG. 5 shows a longitudinal section of the double dispensing cartridge ready for operation, complete with the coupling nut and the mixer tube.
FIG. 6 shows a front view of the two dispensing channels.

Double dispensing cartridge 1 comprises two storage cylinders 2 and 3, the ratio of the cross-sectional areas of said storage cylinders in the present example being 10 to 1. As follows from FIG. 4, the dispensing openings 4 and 5 of cylinders 2 and 3 are about the same size, i.e. they have about the same clear inside diameter. Since also the dispensing channels of known dispensing cartridges have about the same capacity, the necessary time for the small cartridge to fill up this volume after removal of the closure is much longer, i.e. a much greater quantity of the substance from the large cartridge is delivered in the meantime, whereby the mixing ratio of the two substances is incorrect. FIG. 6 illustrates the outlets of the dispensing channels, and it appears that the dispensing outlet 4 of the channel from the large storage cylinder 2 is unchanged and corresponds to the clear width of the dispensing opening of the latter, whereas the cross-sectional area of outlet 6 corresponds to one-tenth of the cross-section of the large storage cylinder. It is possible to injection-mold dispensing openings and dispensing channels having these two diameters directly, but this leads to shrinkage and other problems due to large material accumulations, particularly in the case of high mixing ratios.

A solution for the economical manufacture of dispensing channel outlets in the ratio of the substance components or cartridge cross-sections is explained herebelow with reference to an embodiment, this solution being particularly advantageous in the case of cross-sectional ratios over 2:1. The two storage cylinders 2 and 3 are injection-molded integrally with the connecting piece 7. As follows from the figures, the two dispensing openings 4 and 5, which extend into the two dispensing channels 8 and 9, are quite similar, as required for a ratio of 1:1.

Figures 1, 2, 3, 4:
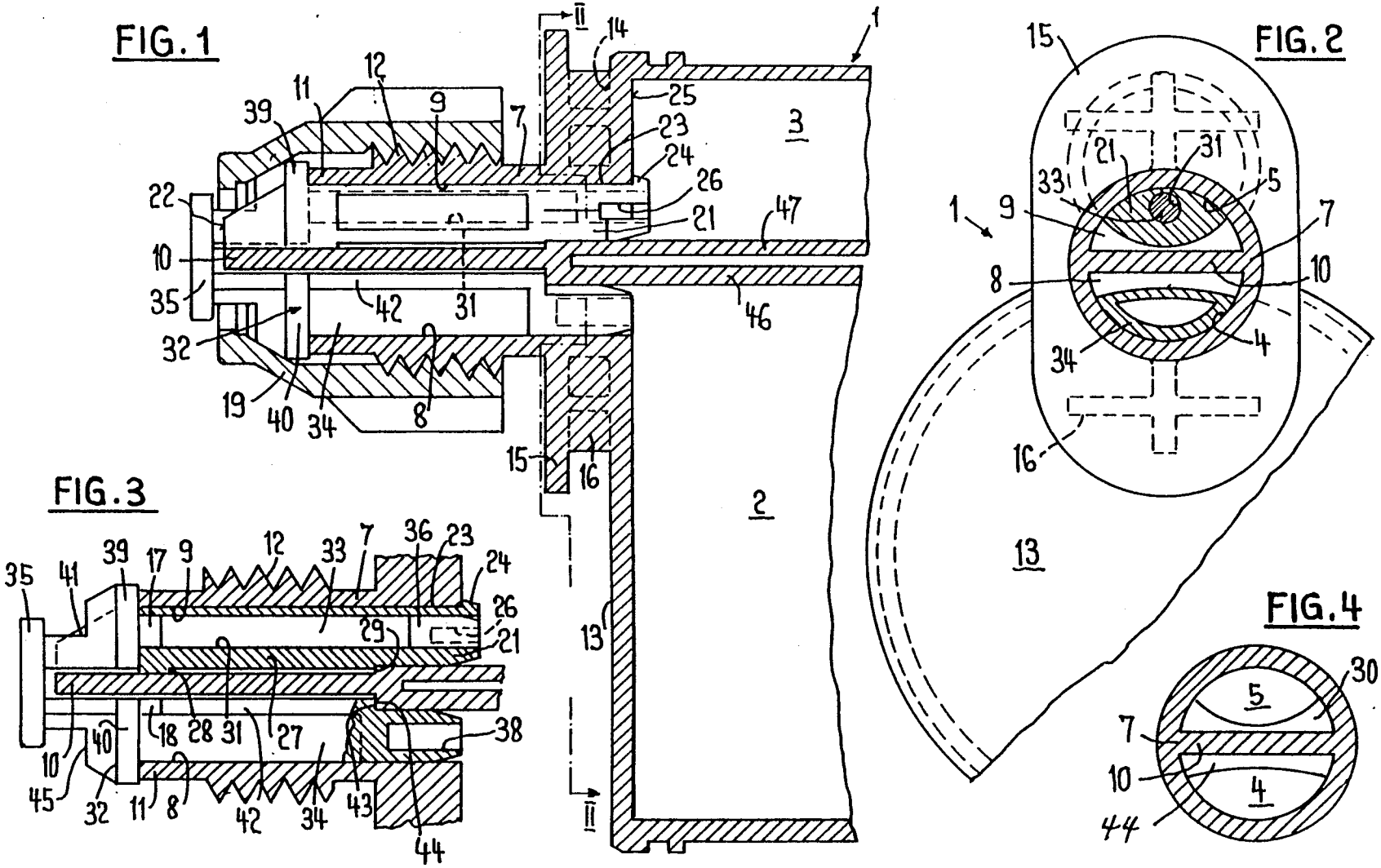
FIG. 1 shows a longitudinal section of a portion of a double dispensing cartridge.
FIG. 2 shows a sectional view along line II—II in FIG. 1.
FIG. 3 shows another longitudinal section of the cartridge according to FIG. 1 without the coupling nut.
FIG. 4 shows a front view of the two dispensing openings of the storage cylinders.

The center wall 10 of the connecting piece, resulting from the union of the two storage cylinder walls 46 and 47, projects from cylindrical wall 11 with thread 12, and is somewhat tapered. It is clearly apparent in FIGS. 1 and 3 that the two separate walls are connected only after the closure area, i.e. above the two closure portions of closure 32, to form center wall 10. A diffusion of the different components before mixing is thereby excluded. The external wall 11 of the connecting piece is not attached directly to the front sides 13 and 14 of the storage cylinders, but to a flange 15 which is connected to the front sides of the storage cylinders by means of an intermediate structure 16. Furthermore, a coupling nut 19 is illustrated in FIG. 1 or 5, said nut securing mixer tube 20 to the connecting piece, amongst others. Mixer tube 20 in itself is known and may e.g. comprise helical elements in order to obtain a thorough mixing of the components.

The ratio of the clear inside diameters, i.e. of the outlets 4 and 6 of the dispensing openings, is determined by an insert 21 which is inserted in the dispensing opening 5 of the smaller storage cylinder 3. Normally, the dispensing opening 4 of the larger cylinder does not contain such an insert, since it may be used as a reference opening in every case. Said insert extends over the entire length of the connecting piece, and its tapered front wall 22 ends even with center wall 10. At the other end, i.e. on the side of the storage cylinder, its outer wall 23, which is adapted to the inner wall of the connecting piece, is provided with a shoulder 24 which engages the inner wall 25 of front side 14 of the smaller storage cylinder, whereby said insert is secured. At the shoulder 24, the lower portion of the insert is provided with a slot 26 in order to obtain a spring effect. The portion 27 of the insert, facing center wall 10, is provided with two steps 28 and 29, the second step 29 on the side of the storage cylinder resting on a corresponding step 30. The two steps 30 and 44 are formed by the upper side of flange 15, see FIG. 4.

In its center, insert 21 comprises a cylindrical insert channel 31 whose cross-sectional ratio with respect to the dispensing channel of the larger storage cylinder is the same as the cross-sectional ratio of the smaller storage cylinder with respect to the larger one.

The two openings are closed by a cap 32, said openings being closed on the level of the inner front side walls of the storage cylinders. Cap 32 is composed of a rod-shaped portion 33 whose lower, cylindrical end 36 is adapted to insert channel 31, and of a peg portion 34 which is adapted to the dispensing channel, i.e. the dispensing opening 4 of the larger cylinder 2. The lowermost part of peg portion 34 comprises a cavity 38 in order to prevent an accumulation of material.

At the top, the rod-shaped portion 33 and the peg portion 34 are terminated by a respective shoulder 39 or a collar 40, said parts resting on the upper end of outer wall 11 of the connecting piece when the cap is inserted. Above said shoulder or said collar, there is a respective rib 45 upon which the coupling nut 19 acts in order to tighten said cap. Shoulder 39 runs in a corresponding groove 41 of the tapered front side 22 of the insert. Both portions of the cap are joined together by a head 35, and the entire cap is injection-molded in one piece.

With reference to liquid material, it may be advantageous or necessary to provide both the rod-shaped portion 33 and the peg portion 34 with a respective sealing lip 17 and 18 at the top.

The inner wall 42 of peg portion 34, which extends along center wall 10, is provided with a step 43 which comes to rest on the corresponding step 44 of flange 15. The disclosed measures guarantee a safe and solid closure.

After removing the cap, mixer tube 20 is secured to the connecting piece by means of coupling nut 19 and, according to FIG. 5, the double cartridge is ready for dispensing in the correct mixing ratio and without any waste of material.

Although the invention has been explained with reference to a double dispensing cartridge for two-component substances, the features of the invention can be used by everyone skilled in the art for a multiple cartride, i.e. comprising more than two storage cylinders, and for multiple component systems. It is understood that cross-sectional ratios of the storage cylinders other than 10:1 are possible as well.

For the sake of simplicity, the described examples are based upon equal lengths of the dispensing channels and of the storage cylinders, respectively, and thus their respective cross-sectional areas have been compared. As a matter of fact, it is essential, however, that the volumes of the dispensing channels correspond to the volumes of the associated storage cylinders.

What I claim is:

1. A dispensing cartridge for dispensing substances to be mixed in fixed ratio, comprising:

a plurality of storage cylinders, each containing one of the substances and each having a different respective cross-sectional area so as to dispense a respective volume of the substance therein, a dispensing opening provided in each cylinder for dispensing the substance therefrom;

a connecting piece having dispensing channels passing through it, each channel being connected with the dispensing opening in a respective one of the storage cylinders, the connecting piece having a common outlet from all of the dispensing channels, a mixer at the common outlet to receive and mix the substances;

each channel having a cross-section which is directly proportional to the cross section of the respective containers to which they are attached so that the ratio of the cross-sections of the cylinders to one another is the same as the ratio of the cross-sections of the respective channels to one another for dispensing the contents of the cylinders into the mixer simultaneously.

2. The dispensing cartridge according to claim 1, further comprising a coupling nut for detachably securing the mixer to the connecting piece.

3. The dispensing cartridge according to claim 2, wherein a first one of the cylinders has a larger cross-section and a second of the cylinders has a smaller cross-section;

an insert provided in the dispensing channel corresponding to the smaller second storage cylinder for reducing the cross-section of the second channel to the ratio between the channel cross-sections.

4. The dispensing cartridge according to claim 3, wherein the first and the second cylinders are located side-by-side.

5. The dispensing cartridge according to claim 4, wherein the insert is a tube extending through the respective dispensing channel from the dispensing opening of the corresponding cylinder to the other end of the connecting piece to reduce the cross-section of the second channel to the ratio between the channel cross-sections.

6. The dispensing cartridge according to claim 5, further comprising a shoulder formed on the insert, the corresponding cylinder having an inner wall so that the shoulder engages the inner wall of the cylinder to secure the insert inside the dispensing channel.

7. The dispensing cartridge according to claim 2, wherein the connecting piece has a front end with an outer front wall, a cap for closing the respective dispensing channels when the mixer is detached therefrom; the cap having a head located in front of the outer front wall of the connecting piece, and the head having respective members extending from the head and adapted to fit the respective dispensing channels.

8. The dispensing cartridge according to claim 6, wherein the connecting piece has a front end with an outer front wall, a cap for closing the respective channels when the mixer is detached therefrom;

the cap having a head located in front of the outer front wall of the connecting piece, and the head having two members extending from the head, a first member being adapted to fit the dispensing channel of the larger cylinder and a second member being adapted to fit the tube to close the respective channels.

9. The dispensing cartridge according to claim 8, the cap further comprising a first collar between the head and the front end of the connecting piece, the first collar resting against the outer front wall of the connecting piece, a second collar between the head and the first collar, the coupling nut engaging the second collar to tightly secure the cap to the connecting piece.

10. The dispensing cartridge according to claim 9, wherein the first and the second members each have a sealing lip, the respective sealing lips engaging the respective channels at the front end of the connecting piece to seal the substance in the channels.

11. The dispensing cartridge according to claim 10, wherein the storage cylinders have walls, the respective walls of the cylinders overlapping onto the first and the second members so as to prevent cross-diffusion of the substances contained therein before mixing.

* * * * *